United States Patent [19]

Dewhirst

[11] 3,963,058

[45] June 15, 1976

[54] CARPET LOOMS

[75] Inventor: Geoffrey Wilson Dewhirst, Dundee, Scotland

[73] Assignee: Thomson Shepherd and Company Limited, Dundee, Scotland

[22] Filed: Mar. 26, 1975

[21] Appl. No.: 562,379

[30] Foreign Application Priority Data

Mar. 26, 1974 United Kingdom ..... 13308/74

[52] U.S. Cl. ..... 139/2; 139/7 R

[51] Int. Cl.[2] ..... D03D 39/02; D03D 39/08

[58] Field of Search ..... 139/2, 3, 4, 5, 6, 7 R–7 E, 139/317; 112/79 R, 79 A

[56] References Cited

UNITED STATES PATENTS

| | | | |
|---|---|---|---|
| 853,471 | 5/1907 | Pearsall | 139/7 D |
| 3,400,738 | 9/1968 | Fleischer et al. | 139/2 |

FOREIGN PATENTS OR APPLICATIONS

| | | | |
|---|---|---|---|
| 525,435 | 8/1940 | United Kingdom | 139/2 |
| 860,207 | 2/1961 | United Kingdom | 139/7 D |
| 1,150,822 | 5/1969 | United Kingdom | 139/7 R |

*Primary Examiner*—James Kee Chi

*Attorney, Agent, or Firm*—Alan H. Levine

[57] ABSTRACT

A method for producing Axminster carpets having two different heights of pile in the same pile forming pick on an Axminster gripper loom. The method comprises engagement of selected yarn carriers on a lifting bar when said yarn carriers move for pile yarn draw-off whereafter the selected yarn carriers are raised and pile yarn drawn-off the selected carriers is raised out of the plane defined by pile yarn drawn-off non-selected carriers.

8 Claims, 5 Drawing Figures

CARPET LOOMS

This invention relates to a gripper Axminster carpet loom and more particularly a method of operating such a loom to produce carpet having two different heights of pile.

Recently a method of producing an Axminster carpet having two heights of pile has been developed in which high and low pile is formed in alternate pile forming picks. (British Patent No. 1286138). More recently, however, we have devised a method of operating a gripper loom so as to produce different heights of pile during weaving in the same pile forming pick. In accordance with this latest development the yarn carriers which are to provide long pile are, by appropriate programming of the jacquard, arranged to be lifted by a supplementary lifting bar through a predetermined distance after grippers have closed onto the selected pile yarns. The selected yarns in the carriers which are given this additional lift are thus raised above the general level of selected pile yarns in carriers not additionally lifted. When the knife box moves across the loom a pile lengthening finger ahead of the knife engages the raised selected pile yarns and increases their drawn-off length before they are severed by the knife.

While this latest method is quite satisfactory it has been found that to provide for the required movement of the supplementary lifting bar the number of movements during a loom cycle is increased. Since it is always desirable to keep the number of movements as low as possible, the present invention has been made with a view to reducing the movements associated with the supplementary lifting bar while still enabling high and/or low pile to be formed in any pile forming pick.

According to the invention there is provided a method of operating a gripper Axminster loom wherein selected yarn carriers are brought into engagement with a lifting bar by movement of the yarn carriers for pile yarn draw-off, whereafter said lifting bar moves said selected yarn carriers to separate pile yarn on said selected yarn carriers from pile yarn on non-selected carriers.

Thus the present invention utilises the movement of the yarn carriers which it is necessary to make for yarn draw-off in any event and the only additional movements required are those necessary to lift the lifting bar. The present invention, therefore, can be applied to conventional looms without affecting the loom speed or the mechanical efficiency thereof.

A specific embodiment of the invention will now be described by way of example with reference to the accompanying drawings in which.

Figure 1A:
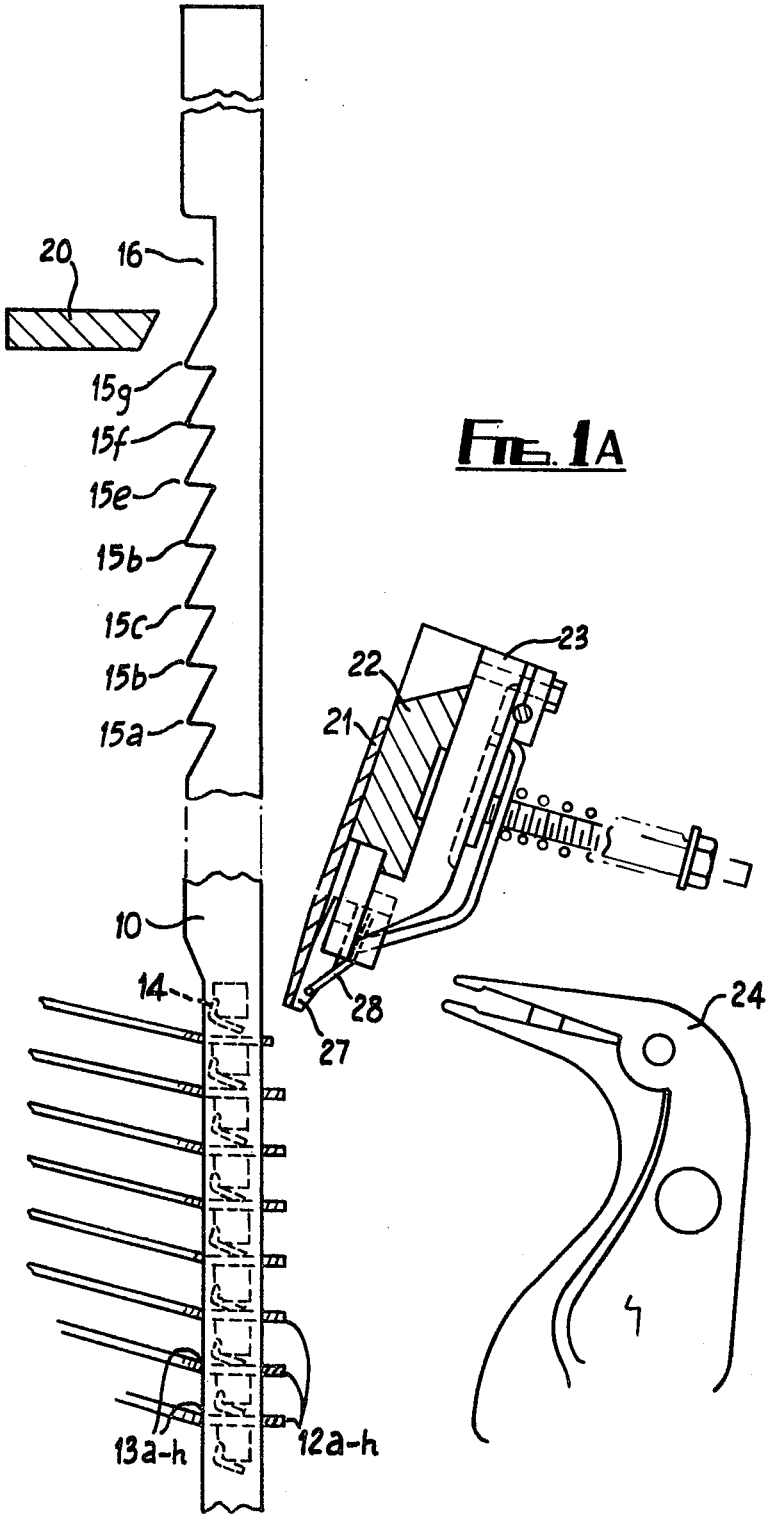
FIG. 1A shows a yarn carrier in side elevation in the neutral position together with its associated gripper and a knife box.

Referring to FIG. 1A a yarn carrier 10 for an eight colour loom is provided with eight spaces 13*a* to 13*h* for holding pile yarns 12*a* to 12*h* respectively. Each yarn is held in place by a spring 14. At the upper end of the yarn carrier serrations 15*a* to 15*g* are provided on the same pitch centres as spaces 13*a* to 13*g* and a cut-out 16 is formed above serration 15*g*.

A lifting bar 20 capable of vertical movement (as will be described hereinafter) is disposed on the side of the yarn carrier adjacent the serrations and cut-out and at a distance therefrom which is less than the horizontal movement to be performed by the yarn carrier for yarn draw-off.

As in conventional looms a gripper 24 is associated with each yarn carrier and a knife box 23 including a comb 21 and knife 27 for severing selected pile yarn from the yarn carriers is mounted on a slide 22. Unlike conventional looms, however, the knife box has mounted thereon a pile lengthening finger 28 which is arranged in advance of the knife blade.

Figure 2:
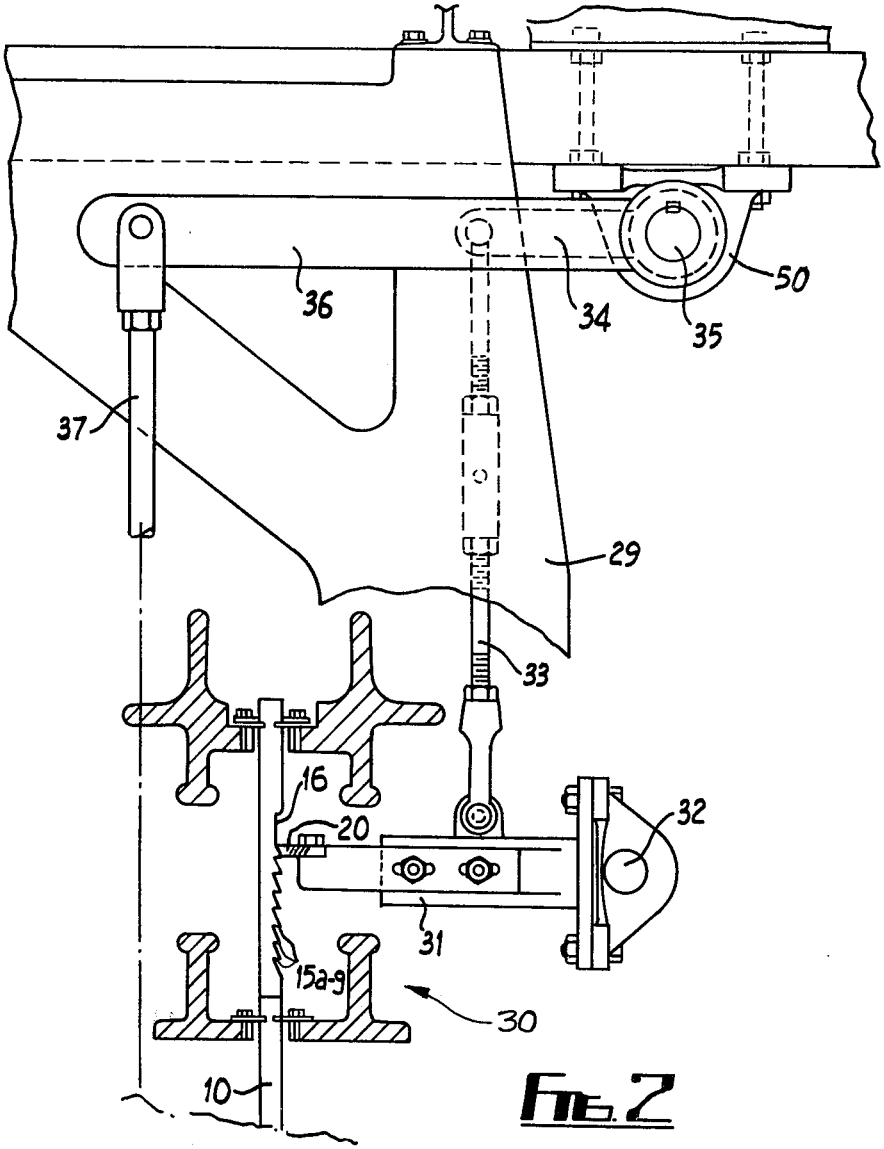
FIGS. 2 and 2A shows diagrammatically and partly in section the means for providing the said further vertical movement.

Referring now to FIG. 2 the yarn carrier 10 is mounted in a yarn carriage 30 so as to be vertically movable relative to the carriage. The lifting bar 20 is secured to one end of a lever 31, the other end of the lever being pivotally mounted on a shaft 32. The shaft 32 is secured by means (not shown) to the loom frame 29. A rod 33 is connected at one end to lever 31 and at its other end to a lever arm 34. The lever arm 34 is mounted on a shaft 35 so as to be rotatable therewith, the shaft being rotatably mounted in bearings as at 50 suitably secured to the loom frame as shown.

Figure 2A:
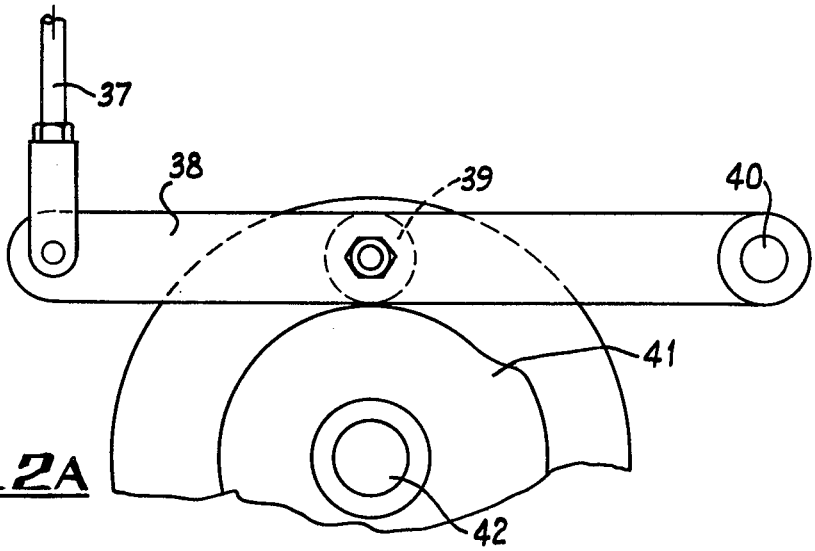

A lever 36 also rigidly secured to shaft 35 is linked by connecting rod 37 to one end of a cam lever 38 (FIG. 2A), the other end of the lever 38 being pivotally mounted at 40. A cam follower roller 39 is mounted on lever 38 and rides on a cam 41 mounted on main loom shaft 42.

The arrangement just described operates as follows:

It is assumed that the jacquard has been programmed so that pile yarn 12*f* of long tuft length is to be selected from the yarn carrier shown in FIG. 1A. Accordingly the yarn carrier is moved vertically upwardly from the neutral position shown in FIG. 1A by a distance equal to the distance between space 13*h* and space 13*f*. The gripper moves anticlockwise (as viewed in FIG. 1A) and the jaws of the gripper close onto the yarn 12*f*.

The yarn carriage now makes a short horizontal movement, carrying with it all the yarn carriers, away from their grippers. The position of yarn carrier 10 at the end of this horizontal movement is shown in FIG. 1B in which it can be seen that a length of yarn 12*f* has been drawn-off the yarn carrier and also that serration 15*f* is now engaged over the lifting bar 20.

Figure 1B:
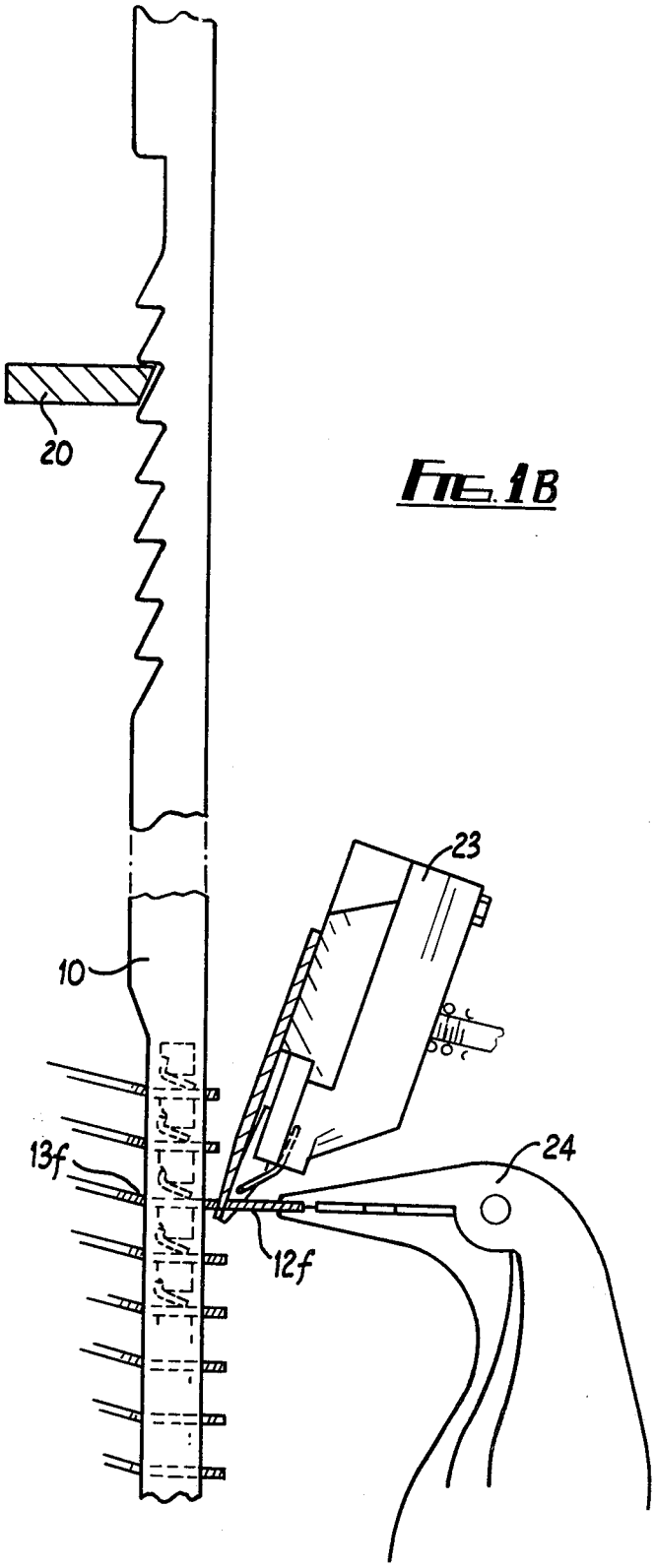
FIG. 1B shows the carrier, gripper and knife box of FIG. 1A after vertical movement in accordance with a jacquard programmed and horizontal movement to create the required length of tuft of selected pile yarn.

When the carrier has reached the position shown in FIG. 1B the rotation of the main loom shaft brings the high part of the cam 41 into contact with the cam follower thus rotating lever 38 clockwise (as viewed in FIG. 2). Shaft 35 is thus rotated clockwise through connecting rod 37 and lever 36. The clockwise rotation of shaft 35 also rotates lever 34 clockwise which lifts lever 31 and the lifting bar 20 fixed thereto.

Figure 1C:
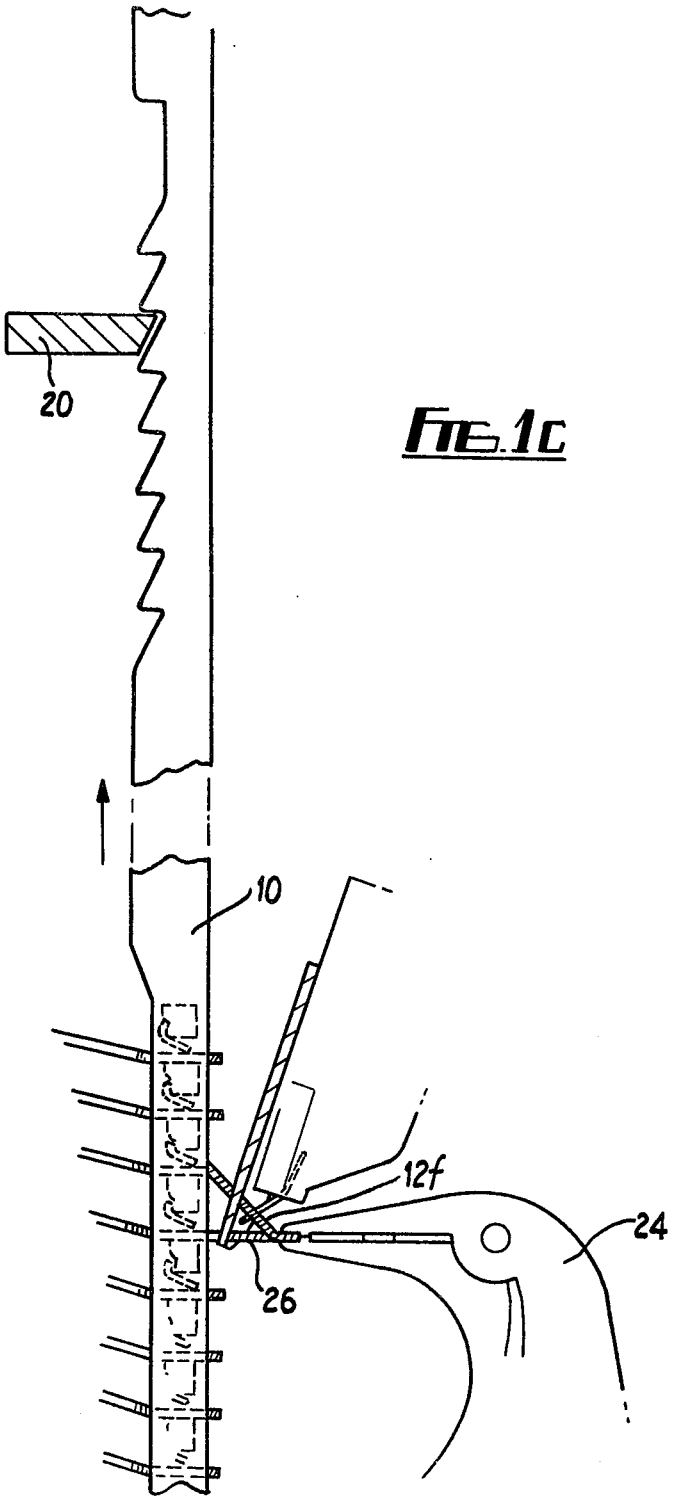
FIG. 1C shows the carrier, gripper and knife box of FIG. 1B after further vertical movement

As the yarn carrier is engaged on the lifting bar, the carrier is also lifted into the position shown in FIG. 1C so that the selected yarn 12*f* is now inclined upwardly from the gripper to the carrier and inclined to the plane of yarns drawn-off non-selected yarn carriers, i.e. carriers not lifted by the lifting bar, one such yarn being referenced 26.

The knife box now travels across the loom on the slide in a direction such that the knife blade is preceded by the pile lengthening finger 28. The finger 28 engages all the selected yarns on those carriers which have been given an additional lift, but does not engage selected yarns on any remaining carriers not given such additional lift. The engagement of the finger 28 with the yarns as aforesaid increases the length drawn-off the carriers before the knife severs them so as to provide a long length of tuft.

The grippers then move, in the conventional way, to insert the tufts into the backing and the parts return to the neutral position shown in FIG. 1A.

If short pile is required, the jacquard is programmed for yarn 12*h* to be selected which requires no vertical movement of the yarn carrier to present the yarn to the gripper jaws. Thus, after the gripper has closed on yarn 12*h* the yarn carriage makes a horizontal movement to draw-off the yarn and whereafter the lifting bar 20 is located in the lower end of recess 16 (see FIG. 2). When the lifting bar subsequently moves upwardly, due to the movements consequent upon the high part of cam 41 engaging cam follower 38, it does not lift the yarn carrier but moves in the recess 16.

It will be understood that the specific embodiment, just described, relates to an eight-colour loom in which short pile is available in one colour and long pile available in the other seven colours. It is, of course, possible, in accordance with the invention, to increase the number of colours available for short pile by enlarging the recess 16 so as to replace one or more of the serrations 15. Further the recess 16 need not be arranged above the serrations, but may be placed below the serrations or intermediate the serrations.

What is claimed is:

1. A method of increasing the length of selected tufts in each row of tufts produced by an Axminster gripper loom having yarn carriers and a gripper associated with each carrier, comprising the steps of:

a. gripping a plurality of yarns in the grippers, b. moving all the yarn carriers away from said grippers, to draw yarn off the yarn carriers, and toward a lifting means into a position wherein a part of at least one selected yarn carrier is in the path of upward movement of said lifting means, all the drawn yarns being in substantially a single plane in the region between the yarn carriers and the grippers, c. raising said lifting means to move at least one selected yarn carrier so as to move its respective yarn out of the plane occupied by the unselected yarns in the region between the yarn carriers and the grippers, d. moving an element crosswise of the yarns along a path such that the element engages only the selected yarn which has been moved out of the plane occupied by the unselected yarns so as to lengthen that yarn by drawing additional yarn off only the selected yarn carrier, and e. cutting all the yarns.

2. A method as defined in claim 1 wherein said element and a cutting knife are moved simultaneously in the same direction, said element moving ahead of said knife so that it engages the selected yarn prior to cutting of the selected yarn by the knife.

3. A method as defined in claim 1 wherein the selected yarn carrier is moved transverse to the direction of said movement of the yarn carriers away from the grippers in order move its respective yarn out of said plane.

4. A method as defined in claim 1 wherein said lifting means is moved only in a substantially vertical direction.

5. An Axminster gripper loom comprising:

a. yarn carriers having abutments, and grippers, b. lifting means, c. means for moving said yarn carriers away from said grippers, to draw lengths of yarn from the yarn carriers, and toward said lifting means into a position wherein an abutment of at least one selected yarn carrier is in the path of upward movement of said lifting means, all the drawn yarns being in substantially a single plane in the region between the yarn carriers and the grippers, d. means for raising said lifting means to engage said abutment and move at least one selected yarn carrier to shift its respective yarn out of the plane occupied by the unselected yarns in the region between the yarn carriers and grippers, e. means for engaging only said selected yarns to lengthen them by drawing additional yarn off the selected yarn carriers, and f. means for cutting all the yarns.

6. An Axminster gripper loom as defined in claim 5 wherein said abutments include a series of spaced apart teeth carried by each of said yarn carriers said lifting means being engagable with any selected one of said teeth on each yarn carrier for moving said yarn carriers.

7. An Axminster gripper loom as defined in claim 5 including a cam for controlling the movement of said lifting means, means for rotating said cam in timed relation to movement of said yarn carriers, and follower means cooperating with said cam for moving said lifting means in a direction which moves said selected yarn carriers to move their respective yarns out of the plane of the unselected yarns.

8. An Axminster gripper loom as defined in claim 5 wherein said means for lengthening the selected yarns and for cutting all the yarns comprises a cutting knife movable across all the yarns to cut them, and a finger spaced forwardly of said cutting knife with respect to the direction of movement of the knife during cutting, said finger being movable with said cutting knife and arranged to engage only said selected yarns.

* * * * *